United States Patent [19]

Coffin

[11] Patent Number: 4,595,801

[45] Date of Patent: Jun. 17, 1986

[54] COUPLED DUAL CONE VELOCITY DRIVER SPEAKER

[76] Inventor: Ronald Coffin, 27 Abbott St., Marblehead, Mass. 01945

[21] Appl. No.: 546,180

[22] Filed: Oct. 27, 1983

[51] Int. Cl.[4] ..... H04R 1/32

[52] U.S. Cl. ..... 179/115.5 PS; 179/116; 381/90; 181/163

[58] Field of Search ..... 179/115.5 PS, 116, 180; 381/90, 89; 181/163, 144, 146

[56] References Cited

U.S. PATENT DOCUMENTS

| | | | |
|---|---|---|---|
| 1,545,718 | 7/1925 | Williams | 179/116 |
| 1,667,251 | 4/1928 | Fay | 179/116 |
| 1,674,895 | 6/1928 | Fay | 179/116 |
| 1,932,459 | 10/1933 | Harris | 179/116 |
| 2,295,527 | 9/1942 | Bowley | 179/115.5 PS |

FOREIGN PATENT DOCUMENTS

| | | | |
|---|---|---|---|
| 2709972 | 9/1978 | France | 179/116 |

*Primary Examiner*—Gene Z. Rubinson
*Assistant Examiner*—L. C. Schroeder

[57] ABSTRACT

This is a dual cone loudspeaker with a primary cone similar in function to a conventional dynamic loudspeaker. There is a secondary cone mounted to a subframe on the back of the magnet structure. A rigid coupling device connects to both cones and causes them to move in unison. Sound waves from the secondary cone travel through an orifice in the center pole piece of the magnet structure and through a hole in the center of the primary cone radiating in the same direction as sound waves from the primary cone. The net effect of this is to generate a louder sound by displacing a larger volume of air than a conventional speaker of equal diameter.

1 Claim, 2 Drawing Figures

COUPLED DUAL CONE VELOCITY DRIVER SPEAKER

SUMMARY OF INVENTION

The invention is an acoustical loudspeaker which may be used to transduce electrically modulated signals into sound waves. It differs from other speakers because it utilizes dual air pistons mechanically linked together to assure sound coherancy; the two linked air cones are interconnected with an air passageway so that with every stroke of the air pistons, large volumes of air are displaced. The net effect of this coupled and interconnected dual air piston speaker system is to give a greater loudness for it's physical dimensions and improved damping of the pistons. This type of speaker is referred to as a velocity driver because the column of air in the passageway moves at a velocity greater than that of the speaker cone itself.

BACKGROUND

Acoustical waves may be generated by a transducer that converts modulated electrical signals into compression waves in air. This is commonly done by an electromagnetic system that drives an air piston commonly called a speaker cone. The electromagnetic portion consists of a voice coil which is placed in the field of permanent magnetic pole pieces. The coil is rigidly attached to a conically shaped diaphram which moves in accordance with the current in the coil; this conical diaphram acts as an air piston and is commonly known as a speaker cone. The volume of the air displaced in every excursion of the air piston determines the loudness of the sound; the time rate of excursions determine the frequency. Ordinarily, a high-power audio speaker obtains loudness by having physically large air pistons. In this invention, a single large air displacement is caused by each excursion of the coil because the inventor has mechanically and pneumatically coupled together two air pistons of approximately equal area. The two air pistons are back to back and operated from a common coil and permanent magnet and the pistons are mechanically coupled by a rigid link and pneumatically coupled by an interconnecting orifice.

DRAWING DISCRIPTION

FIG. ONE shows a front view of the speaker.

FIG. TWO shows a diametrical cross section of the speaker.

DETAILED DESCRIPTION

Figure 1:
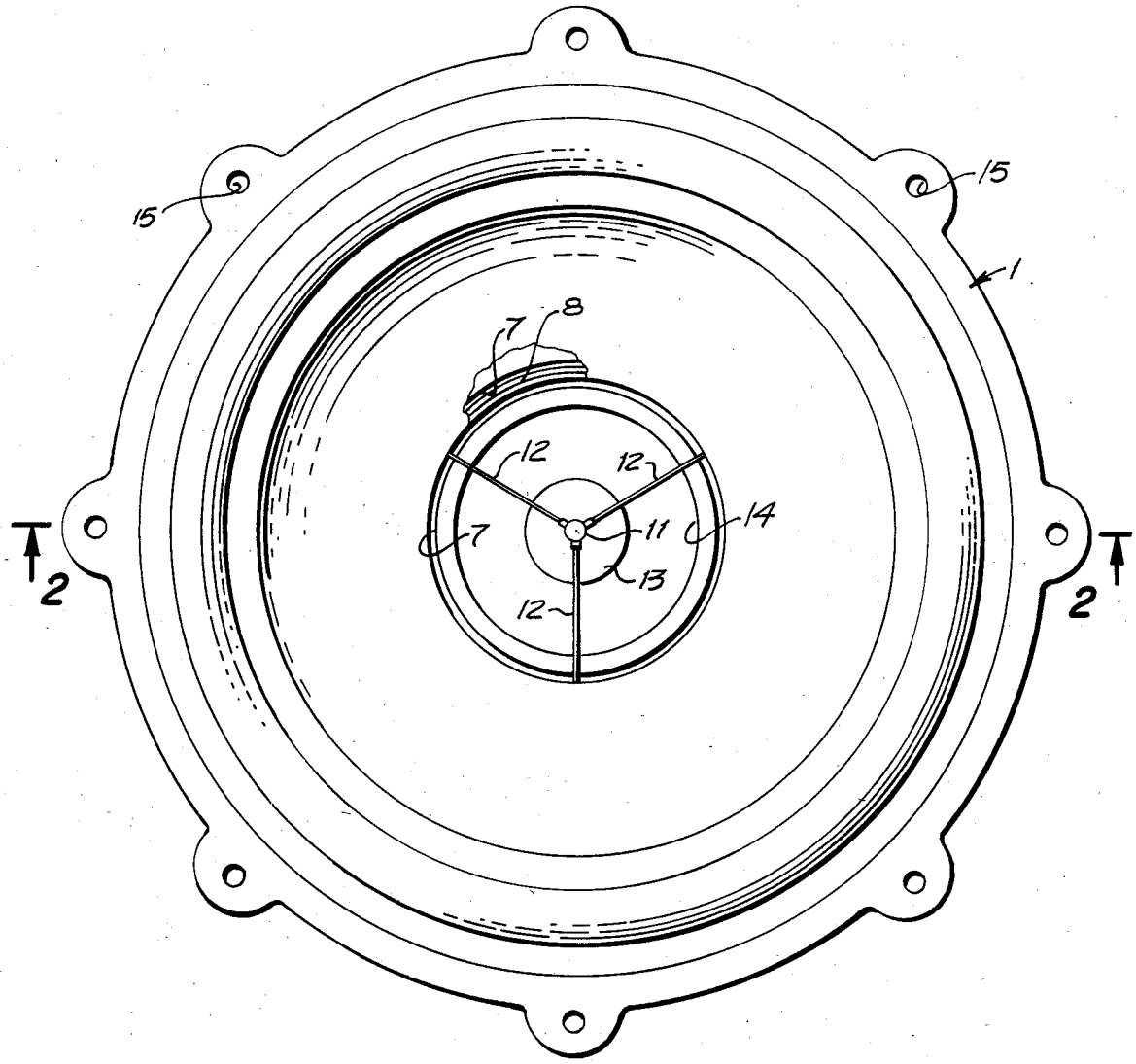
Figure 2:
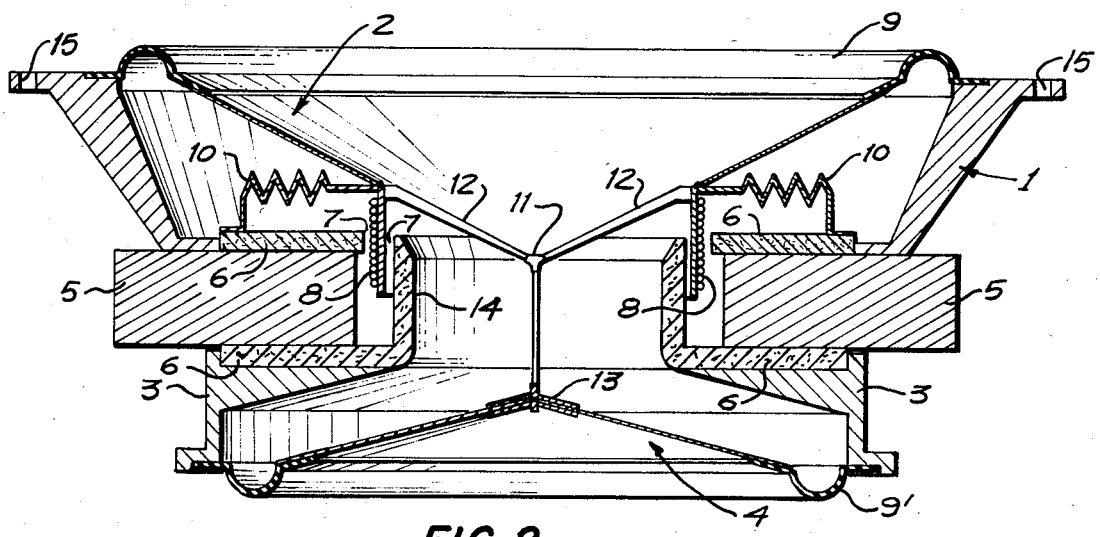

The speaker, as shown in FIG. TWO, comprises several parts. There is a rigid frame (1) to which the primary cone (2) is attached, and a sub-frame (3) to which a secondary cone (4) is attached. Both frames (1) and (3) are mounted to the permanent magnet (5) to which pole pieces (6) are attached to form the magnetic field gap (7) into which the voice coil (8) is placed; the voice coil is attached to the base of the primary cone (2). The primary cone (2) is resiliently suspended from the frame (1) by a flexible surround (9) at it's top, and a spider (10) at its bottom. A rigid coupling device (11) mechanically connects to the voice coil (8) through attached radial spokes (12) and to the secondary cone (4) by a center attachment (13). The secondary cone (4) is attached to the sub-frame (3) by a flexible surround (9'). The secondary cone (4) forms a second air piston which is pneumatically coupled to the primary cone (2) air piston by the orifice (14) which is common to the closed chamber formed by the secondary cone (4) and sub-frame (3) and the open chamber of the primary cone (2). There is a multiplicity of mounting holes (14) in the frame (1).

When the voice coil (8) is energized by a current surge, electromagnetic forces in the magnetic field gap (7) cause the primary cone (2) to be displaced. Because of the attachments of the rigid coupling device (11) to the voice coil (8) at the radial spokes (12) and the center attachment (13) to the secondary cone (4), the air in the closed chamber of the secondary cone (4) is pumped into the open chamber of the primary cone (2) through the orifice (14). As a consequence, a larger volume of air will flow than if there were only a primary cone. The larger volume of air displaced will result in a louder sound. This speaker occupies a cross sectional area no bigger than a simple speaker that has only a primary cone.

Because of the greater mass of air coupled to the dual set of air pistons of the primary and secondary cone, there is more dynamic damping of the speaker, which will improve the fidelity of the sound.

I claim:

1. A coupled dual cone velocity driver speaker which is an improved acoustical transducer having a frame, a sub-frame, a permanent magnet, an inner magnetic pole piece, an outer magnetic pole piece, a voice coil, a primary and a secondary cone, with the primary and secondary cones being mounted to the frame and sub-frame respectively by a resilient suspension wherein the improvement comprises the pneumatic coupling of said primary and secondary cones by an orifice in the center of said primary cone and said inner magnetic pole piece and the mechanical coupling of said primary and secondary cones by a rigid coupling device so that when said voice coil is energized with electrical current within the field of said magnet, the resulting force causes both the primary and secondary cones to move in unison causing sound waves from the secondary cone to travel through the orifice joining with and radiating in the same direction as sound waves from the primary cone.

* * * * *